US005263613A

United States Patent [19]

Billings

[11] Patent Number: 5,263,613

[45] Date of Patent: Nov. 23, 1993

[54] HIGH-VOLUME BEVERAGE DELIVERY STRUCTURE

[76] Inventor: Chris L. Billings, 527 Miller Ave., Layton, Utah 84041

[21] Appl. No.: 835,406

[22] Filed: Feb. 14, 1992

[51] Int. Cl.[5] ..... B67D 5/56

[52] U.S. Cl. ..... 222/129.1; 222/145; 222/265

[58] Field of Search ..... 222/129.1, 132, 145, 222/265, 129.4

[56] References Cited

U.S. PATENT DOCUMENTS

| | | | |
|---|---|---|---|
| 2,955,726 | 10/1960 | Feldman et al. | 222/129.1 |
| 3,034,685 | 5/1962 | Breitenstein | 222/129.1 |
| 3,067,987 | 12/1962 | Ballou et al. | 222/145 X |
| 3,460,717 | 8/1969 | Thomas | 222/145 X |
| 4,392,508 | 7/1983 | Switall | 222/145 X |
| 4,658,988 | 4/1987 | Hassell | 222/129.1 |
| 4,687,120 | 8/1987 | McMillin | 222/129.1 X |
| 4,753,370 | 6/1988 | Rudick | 222/129.1 X |
| 4,979,639 | 12/1990 | Hoover et al. | 222/129.1 X |
| 5,152,429 | 10/1992 | Billings | 222/129.4 X |

*Primary Examiner*—Andres Kashnikow
*Assistant Examiner*—Kenneth Bomberg
*Attorney, Agent, or Firm*—M. Ralph Shaffer

[57] ABSTRACT

A high volume beverage delivery structure or apparatus, preferably encased in a single self-contained unit, wherein the same includes a high-volume water line provided with a multiple-inlet junction or junction unit. Feeding such junction or junction unit are a series of suitably driven liquid supply pumps, connected together either unitarily or in tandem, for providing respective juices, syrups, concentrates, and/or other liquids or fluids to the pumps for supply thereof to the multiple-inlet junction unit interposed in the high volume water line. Suitable valving is provided for control of the respective pumping branches, and the system is designed in an over-all manner such as to accommodate any one of several concentrates, etc., which are to be additives to the water supply system.

3 Claims, 3 Drawing Sheets

HIGH-VOLUME BEVERAGE DELIVERY STRUCTURE

FIELD OF INVENTION

The present invention relates to and provides a high-volume beverage delivery system and structure and structure for use in hospitals, military establishments, correctional institutions, and similar uses.

BACKGROUND AND BRIEF DESCRIPTION OF PRIOR ART

Relating to beverage delivery, familiar to all are the soda fountains and other installations which mix water with juice or concentrate, and likewise sometimes provide carbonation, this for supplying individual customers. An entirely different problem is presented for high volume usage. This is to say, the present invention is directed toward the need of providing beverages in large volumes to institutions such as hospitals, correctional facilities, government offices, military bases, and so forth, this wherein small containers or even multiple-gallon containers are really not practical for supplying beverages in substantial volumes at one or more particular locations. The present invention is directed toward supplying a unit wherein large volumetric flows of base liquid such as water is utilized with the appropriate valves and also with pumps, either individually functioning or connected in tandem or parallel, for supplying extracts, concentrates, juices, syrups and the like to the multiple-inlet junction of the unit accommodating water flow.

No art is known, patent or otherwise, which teaches the concept of high-volume systems and units for supplying beverages to large installations in the manner provided by this invention.

BRIEF DESCRIPTION OF INVENTION

In the present invention a high-volume dispensing apparatus or structure will generally include a housing and a cover which can be secured together to prevent access by unauthorized personnel. Water is conducted through a principal conduit through the unit, having at some intermittent point a multiple-inlet junction unit. To the auxiliary supply inlets of this junction unit are fed or pumped concentrates, extracts, juices, syrups and the like. Thus, in a preferred form of the invention there will be several pumping units contained within the housing of the unit, and these pumping units compromise respective pumps as secured in any desired manner to and within such housing. Valving controls are provided both the main water line and also the auxiliary extract or syrup lines, e.g., so as to provide requisite syrups and the like to the junction unit contained within the main water line. A variety of extracts, syrups, concentrates, fruit juices and other beverage elements can be introduced in relatively small volumes into the large-volume water flow, this to provide a treated outlet suitable for desired consumption as beverages. Multiple liquid-additive storage units are supplied, and these can be large tanks, barrels and the like to provide the needed liquid additives for the beverages in question.

In this way the transport of extracts, syrups and the like in relatively small quantities from place to place in large installations, is avoided.

OBJECTS

Accordingly, a principal object of the present invention is to provide a high-volume beverage delivery structure, apparatus and system.

A further object is to provide beverage delivery structure which automatically and selectively mixes with high-volume water flow the desired extracts, juices, syrups, and the like, for flavoring the water appropriately for human consumption as beverages.

An additional object is to provide a high-volume beverage delivery system which will accommodate plural numbers of beverage additives, so that different beverages can be selectively obtained from the unit.

A further object is to provide a high-volume beverage distribution unit having suitable valving controls for regulating both inlet water flow, for shutting off flow, and for regulating the character of inlet flow of syrups and concentrates relative to the multiple-inlet junction unit contained within the housing of the structure.

The features of the present invention, both as to its organization and manner of operation, may be best be understood by reference to the following specification and description, taken in connection with the accompanying drawings in which:

DRAWINGS

DETAILED DESCRIPTION OF THE INVENTION IN ITS PREFERRED EMBODIMENTS

Figure 1:
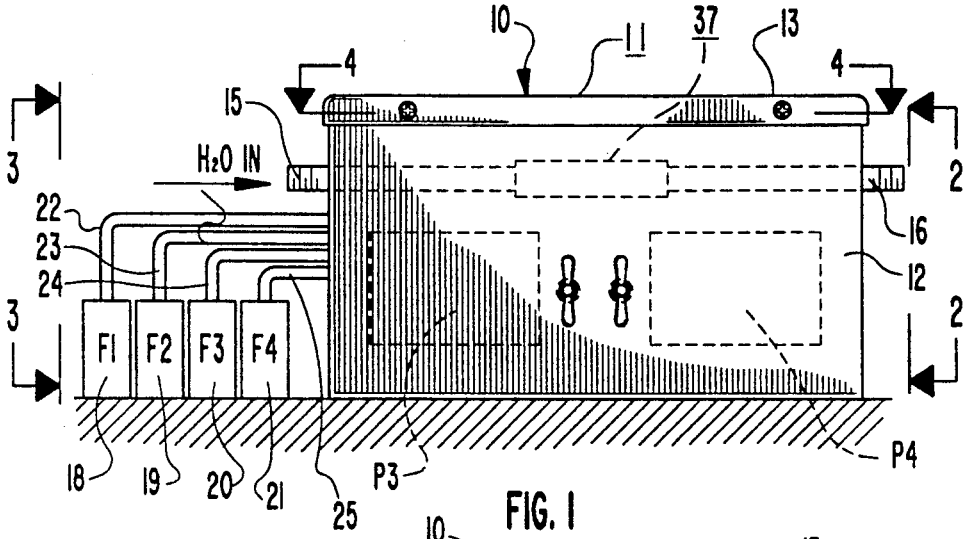
FIG. 1 is a side elevation of a high-volume beverage delivery structure constructed in accordance with the principles of the present invention, and showing various liquid or fluid inputs.
Figure 2:
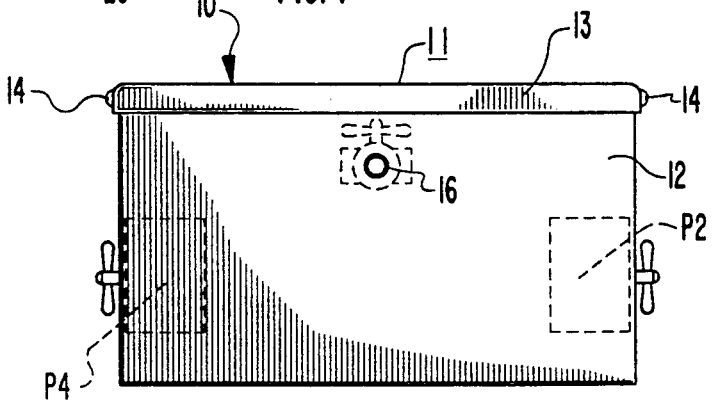
FIG. 2 is an end view taken along the line 2—2 in FIG. 1.
Figure 3:
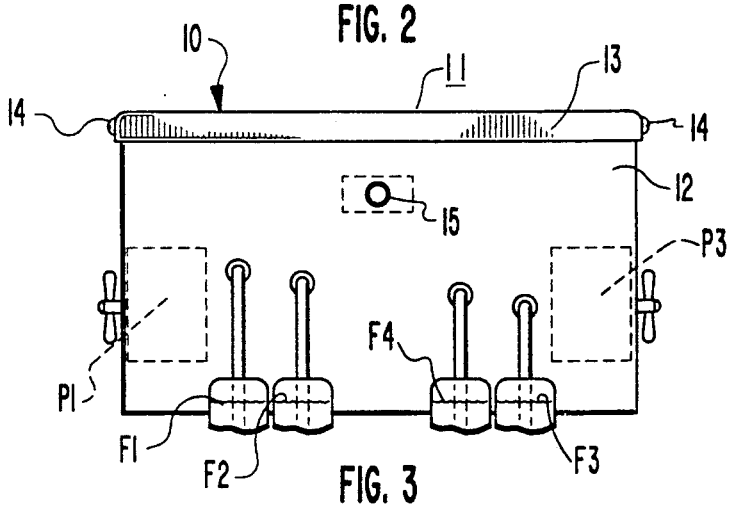
FIG. 3 is an end view taken along the line 3—3 in FIG. 1.

In FIGS. 1–4 the high-volume beverage delivery structure 10 compromises a unit 11 having housing 12 and cover 13 affixed thereto by screws or other means 14. A series of pumping units P1–P4 are contained within and preferably secured to housing 12, this by screws, or other attachments, not shown.

Pressurized high-volume water inlet 15 leads into the housing 12 and is joined to pressurized outlet 16 by junction or junction unit structure 37 which will be explained hereinafter. A series of fluid containers 18–21 are respectively provided with respective concentrates such as fruit juices, syrups, or other beverage liquids which are intended for mixing with the high pressurized water at inlet 15. Thus, containers 18–21 are provided with conduit 22-25 for conducting the respective fluids F1-F4 into housing 12 to connect to the respective pumps P1-P4, as indicated. Conduit 22-25 are respectively coupled to the several pumps P of pumping units P1-P4 in the manner illustrated. These conduit are connected of course to the inlet or intake sides of the respective pumps. The pressure lines of the several pumping units P1-P4 connect with respective lines 26-29 each of which includes a flow control valve 30 and check valves 31 and 32. Accordingly, each of the fluid lines, consider the fluid line associated with fluid Fl, for example, includes a pressured outlet line 26 which is provided with initial check valve 31, flow control valve 30 provided with and control 30A, and also final check valve 32. The same type of structure will apply to all the remaining fluids, i.e. liquids F2-F4 in conjunction with their respective pumping units P2-P4. A pressurized water line is provided, again, with inlet and outlet lines 15 and 16, each having a respective inlet valve 33 and shut-off valve 34. Both of these valves may be provided with manual or other types of controls at 35 and 36 for regulating and shutting off fluid flow.

Figure 4:
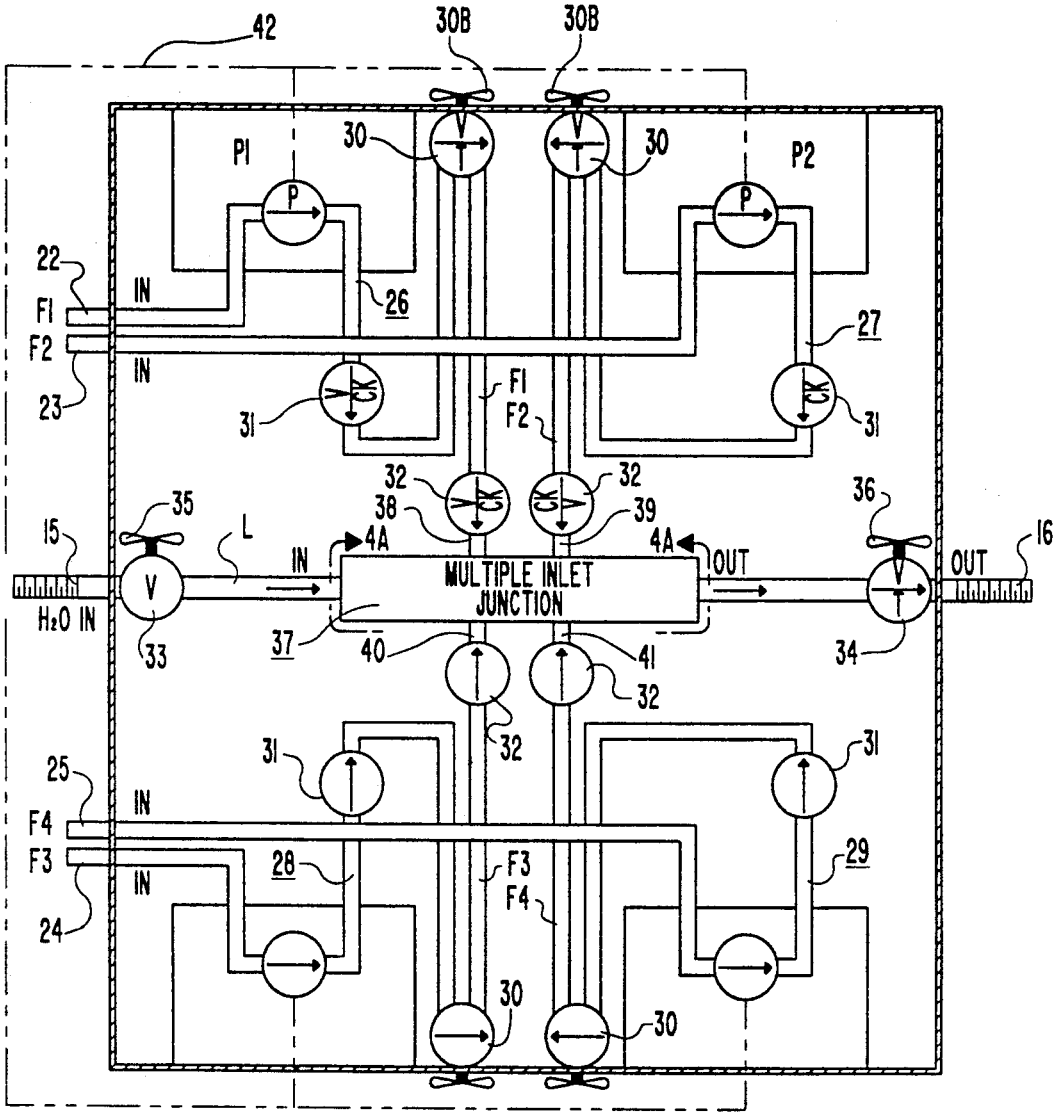
FIG. 4 is an enlarged top plan of the unit, with the cover removed, showing in schematic form the various elements and conduit of such unit with its respective valves and so forth.
Figure 4A:
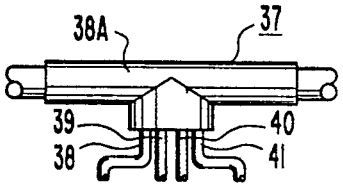
FIG. 4A is a detail taken along the arcuate line 4A—4A in FIG. 4, illustrating that the multiple-inlet junction may compromise simply a tee, with the same having multiple-inlets which feed into the principal water line of the unit.

A multiple inlet junction or junction unit 37 is provided and may simply take the form of a conventional tee 38 as illustrated in FIG. 4A. Whatever the particular configuration of the junction unit 37, the same will accommodate connection to the several pressure lines leading from the respective pumping units P1-P4 proximate the final check valves 32 of these lines. Connections to the junction unit are seen as stub conduit 38-41. Where a conventional tee is used, or a cross or other connector, not shown, having a fifth central aperture may be coupled to the tee 38 to provide for communication of all of the stub lines 38-41 to the junction unit proper.

In operation, a source of pressurized water is coupled to inlet conduit 15 which leads to the multiple inlet junction 37, this usually taking the form of simply a tee connection 38A. Outlet 16 is provided the shut-off valve 34 which can be manually controlled at 36. Inlet valve 33 is provided in the inlet conduit 15 that may be turned off by handle or other structure at 35. Fluid, again, namely syrups, concentrates, extracts, juices and/or other additives so forth may be supplied in many varieties and four such fluids, merely be way of example, are indicated at F1-F4. Powering system 42 is shown in phantom line only in generic fashion and may refer to electrical, pressurized carbon-dioxide, or pressurized water fluid drives for the respective pumps. In other words, the pumps may be electrically driven or driven by a suitable pressurized fluid to produce steady, continuous flows of additives, from the several continuous- or steady-flow pumping units employed and shown, to junction unit 37 as seen at 42.

If one particular liquid F1 is selected for intermixture with the pressurized water at 15, then the control 30B, FIG. 4 upper left, is manipulated so that the control valve 30 passes the liquid F1 leading from pump F1 and respective check valve 31 to check valve 32 and outlet stub line 38 connected to multiple inlet junction 37. If liquids F1 and F2 are to be intermixed with the high-volume water flow at 15, then the controls 30A of the respective flow control valves 30 for the respective pumps P1 and P2 may be simultaneously opened to provide for both fluids simultaneously at junction unit 37, e.g., tee 38A, for example. Normally, however, only one flow control valve 30 will be turned on at a time, this depending on the concentrate selection to be made. Check valves are indicated to preclude the force of the water to appear at the outlets of the several pumps. Customarily the water pressure system will be operated at 70 to 110 psi, whereas pumps P1-P2 will pump at pressures form 30 to 70 psi or lower. As a practical matter, many the Bernoulli effect will obtain at the junctions of stubs 38-41 with the junction unit so that in fact check valves may not be necessary. Their use is an added safety precaution, however. Accordingly, variable flow control valve 30, which is associated with the pump for the fluid being selected, will be opened to provide for the introduction of such syrup or concentrate, i.e. F1 or F2, for example, so that the same can be mixed with the water and carried thereby out of outlet conduit 16 when shut off valve 34 is open. In the system shown in FIG. 4, any one of four liquids may be mixed with the pressurized water. Obviously there can be as many pumps and pumping circuits as seen by the representative circuits in FIG. 4, as required, depending upon number of syrups and concentrates from which selection is to be made.

It is contemplated that fluid flow relative to the high volume water supply will be from 5 to 10 gallons per minute, for example, at approximately 90 psi. Syrups and concentrates, however, may constitute a flow of one-half gallon per minute or less, depending upon the character of the concentrate or additive.

Figure 5:
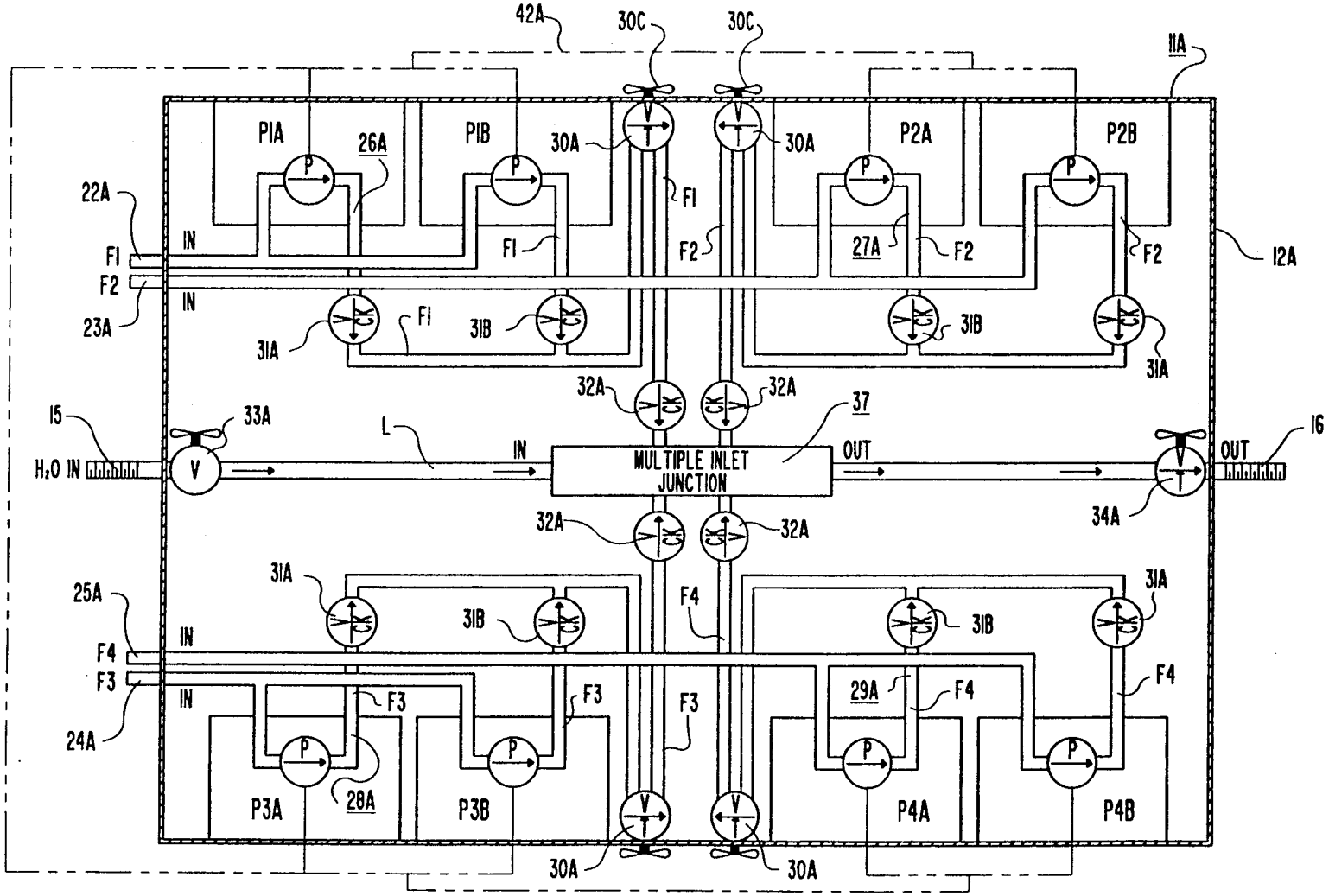
FIG. 5 is similar to FIG. 4, but illustrates an alternate form of the invention where plural pairs of pumps are used for each respective liquid inlet, this to provide both increased volumetric flow and also back-up in the system as hereinafter described.

FIG. 5 illustrates an alternate embodiment wherein at each pumping station or pumping unit a pair of pumps are supplied and are connected in tandem or parallel for each respective concentrate or juice. Respective pump pressure lines 26A-29A are illustrated. Accordingly, the pumps P at pumping units P1A and P1B are coupled together in tandem, i.e. parallel or shunt relationship. The same likewise supplies to the remaining pairs P2A-P2B, P3A-P3B and P4A-4B. It is thus seen in FIG. 5 that there are a first series of fluid pumping units P1A, P2A, P3A and P4A, and a second series of fluid pumping units P1B, P2B, P3B and P4B, each unit comprising a pump P, and with the pumps being coupled in shunt, i.e. tandem or parallel relationship as to the respective pumping unit pairs, e.g., P1A-P1B, P2A-P2B, P3A-P3B and P4A-P4B. As is illustrated in FIG. 5, additional check valves 31B are supplied in addition to the check valves 31A that correspond to check valves 31 in FIG. 4. Manual controls 30C are supplied the on/off flow control valves 30A, corresponding to valves 30 in FIG. 4. Accordingly, the pumping units connected in tandem pump a single concentrate or juice through parallel paths to their respective flow control valves 30A the outputs from which lead through check valves 32A to the multiple inlet junction 37, see also FIG. 4. Arrows in the respective check valves illustrate of course direction of liquid flow. Accordingly, pumping units P1A and P1B pump parallel branches of liquid at F1 which join in a common flow proximate check valve 31B to and through the control valve 30A; the output from the latter proceeds through valve 32A to the junction or junction unit 37. Corresponding flow paths are joined and are pumped through the remaining check valves to the multiple inlet junction or junction unit 37. The inlet 15 of composite line L with its valves and junction unit can be simply the same as that shown in FIG. 4 relative to the former embodiment.

The operation of the unit seen in FIG. 5 is essentially that of FIG. 4, save only for the tandem or parallel pump feature for each of the fluids F1-F4. The purpose for the inclusion of a pair of shunting pumping units, e.g. P1A-P1B, for each fluid is to provide back-up pumping facility should one pump of the pair fail in operation. In such event there can be an adjustment as to valve 33A so that the inlet water flow is reduced to accommodate the half-volume flow of the pumping unit relative to its concentrate. Another reason for dual pumps being connected in tandem at each station is to provide for increased juice, syrup or concentrate flow to accommodate very large volume systems. In such event standard pumping designs may not be sufficient to accommodate or produce a sufficient flow of concentrate for the overall water flow character present. System 42A generically refers to whatever drive system is used to actuate the several pumps at pumping units P1A, P1B and so forth. Thus, system 42A may compromise an electrical power circuit for driving the pumps. Optional drive systems include the customary pressured carbon-dioxide systems, water flow fluid driven pumps relative to the pumping units, and so forth.

While particular embodiments have been shown and described, it will be obvious the various changes and modifications may be made without departing from the essential aspects of the invention and therefore the aim of the impended claims is to cover all such changes and modifications as fall within the true spirit and scope of the invention.

I claim:

1. A high volume beverage delivery apparatus including, in combination, a pressurized-water inlet line having an adjustable intake control valve means, a water mixture outlet line, a junction unit interposed between and intercoupling said water inlet line and said outlet line, said junction unit having multiple auxiliary inlets for receiving fluid additives to mix with water from said water inlet line as water passes through said junction unit, a first series of operating, fluid pumping units each comprising a pump having an additive inlet and an additive pressure outlet, said additive inlets of said pumps being constructed for respective fluid coupling to sources of additive fluid supplies, said additive pressure outlets of said pumps having respective lines respectively coupled to said multiple auxiliary inlets of said junction unit for selectively supplying respective additives to said junction unit, said water mixture outlet line being provided with a shut-off valve and means for coupling the water mixture thereof to an external delivery system, and a second series of fluid pumping units each comprising a pump, having an additive inlet and an additive pressure outlet, respectively shunted across respective ones of said pumps of said first series of said fluid pumping units, whereby to increase additive volumetric flow to said junction unit and to serve as back-up to said pumps of said first series of said fluid pumping units in the event of pumping unit failure, said adjustable intake control valve means being thereby adjustable to regulate incoming water flow in accordance with fluid pumping unit conditions.

2. The apparatus of claim 1 wherein said apparatus also includes a housing, said pumping units being mounted to and within said housing and provided valve controls projecting through said housing for exterior manipulation, said junction unit also being contained by said housing.

3. The apparatus of claim 2 wherein said housing is provided with a secured access cover.

* * * * *